United States Patent [19]

Cagle

[11] 4,269,349

[45] May 26, 1981

[54] SOLID FUEL FURNACE

[76] Inventor: Bunyan B. Cagle, 1700 Towson Ave., Fort Smith, Ark. 72901

[21] Appl. No.: 18,669

[22] Filed: Mar. 8, 1979

Related U.S. Application Data

[63] Continuation-in-part of Ser. No. 813,962, Jul. 8, 1977, Pat. No. 4,149,671.

[51] Int. Cl.[3] ..... F23N 1/02

[52] U.S. Cl. ..... 236/11; 126/112

[58] Field of Search ..... 236/11; 126/110 R, 110 B, 126/116 R, 112; 137/527.8; 251/82

[56] References Cited

U.S. PATENT DOCUMENTS

| | | | |
|---|---|---|---|
| 1,813,732 | 7/1931 | Freeman | 236/11 |
| 2,801,055 | 7/1957 | Seifert | 236/11 X |
| 4,140,274 | 2/1979 | Nabinger | 236/11 |
| 4,149,671 | 4/1979 | Cagle | 126/112 X |

*Primary Examiner*—William E. Tapolcai, Jr.
*Attorney, Agent, or Firm*—O'Brien and Marks

[57] ABSTRACT

A solid fuel furnace is disclosed as including a firebox disposed inside of a heating chamber through which air to be heated is passed. A pair of baffles guides the air through the heating chamber to progressively heat the air. In addition, an auxiliary air system is provided to inject air into the fire when there is a heating demand to increase combustion and provide more heat when it is most needed.

A modified solid fuel furnace is also disclosed which includes a combustion chamber having a door designed to prevent flash-back when the door is opened, a valve for preventing a flow of combustion air to the combustion chamber when the temperature in the combustion chamber rises above a present level, and a manual override for the valve. In addition, a plurality of thermostats and switches are inter-connected with a circulating air blower and a combustion air fan for combined regulation of the temperature in the combustion chamber, the temperature of the circulating air and the temperature in the room to be heated.

2 Claims, 11 Drawing Figures

FIG. 8
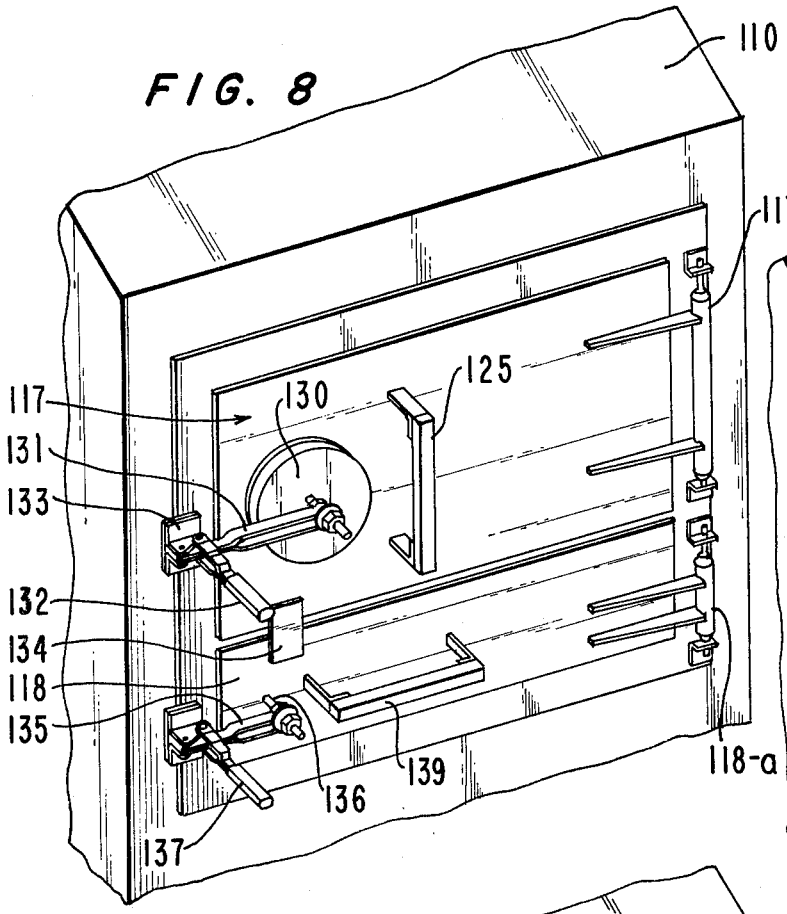
FIG. 9
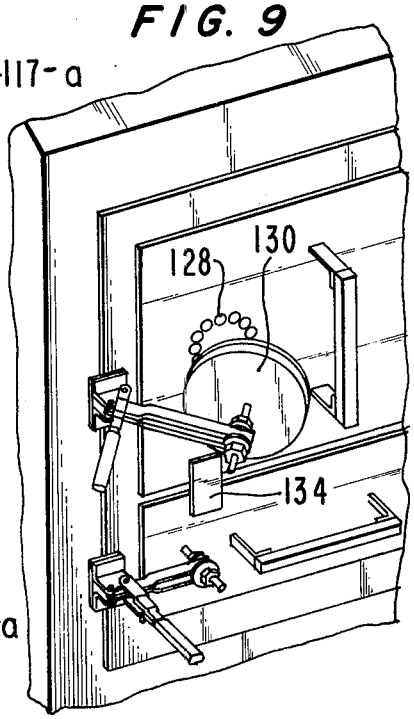
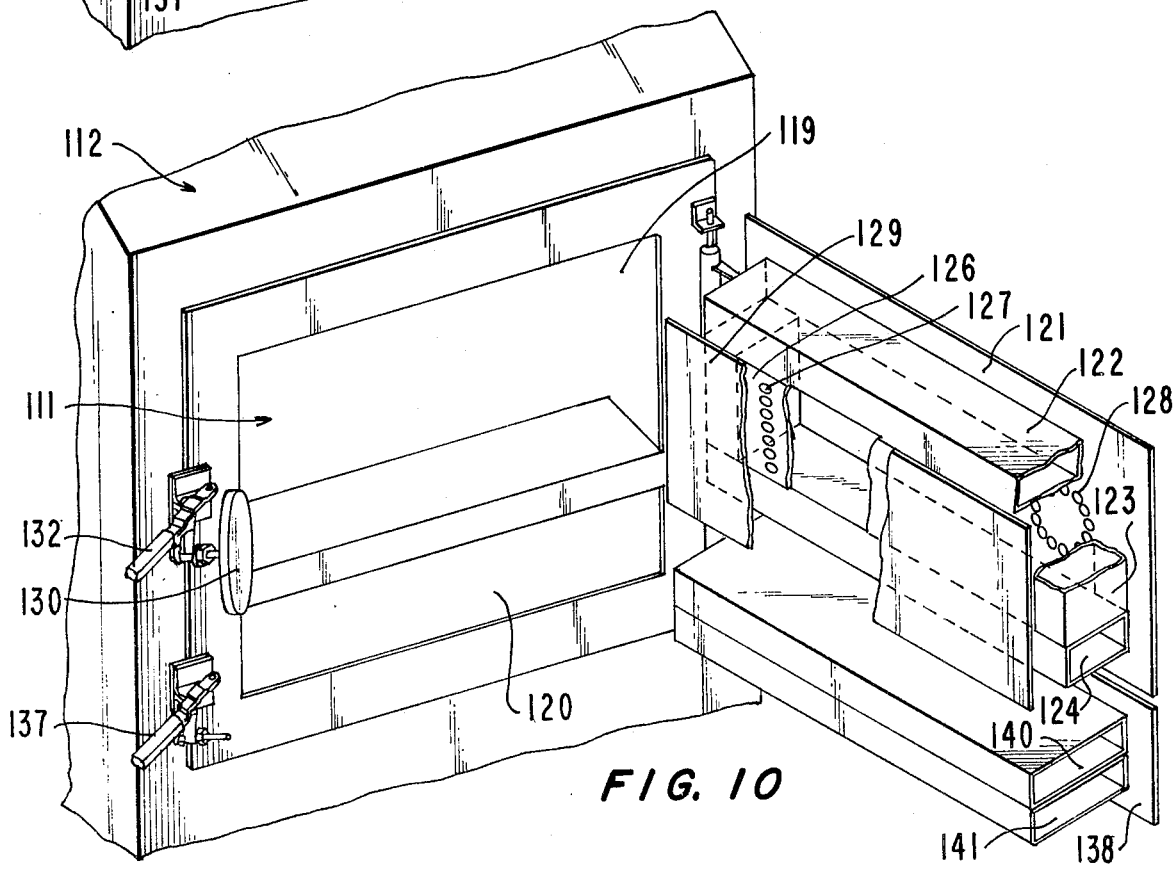
FIG. 10

SOLID FUEL FURNACE

CROSS REFERENCE TO RELATED APPLICATION

This is a continuation-in-part application of parent application Ser. No. 813,962 filed July 8, 1977, now U.S. Pat. No. 4,149,671, which parent application is hereby incorporated by reference.

BACKGROUND OF THE INVENTION

1. Field of the Invention

The present invention relates to furnaces in general and in particular to solid fuel fired furnaces of the type having an air jacket around the firebox to pass heated air through.

2. Description of the Prior Art

The prior art is generally cognizant of solid fuel heaters in which air is forced around or through the actual fire chamber by an electric blower. U.S. Pat. Nos. 1,490,135 and 3,219,024 are examples of heaters including such blowers. The prior art is also cognizant of solid fuel heaters having special air tubing to admit air to the combustion area, as shown by U.S. Pat. Nos. 1,596,922 and 2,456,570. Other examples of furnaces having fire chambers around which air is directed are U.S. Pat. Nos. 419,122, 1,034,799, 1,697,225 and 2,513,443.

SUMMARY OF THE INVENTION

The present invention is summarized in that a solid fuel furnace includes a firebox for containing the fire, a heating chamber surrounding the firebox, a thermally responsive fan switch located in the furnace, a circulating air fan controlled by the fan switch to force air through the heating chamber and around the firebox to supply heated air, a combustion air manifold inside the firebox, a room thermostat located in a room, and a combustion air blower controlled by the thermostat and connected to the combustion air manifold to inject air into the fire to increase the rate of combustion of the fire when there is a heating demand.

It is an object of the present invention to construct a solid fuel furnace which conserves fuel by causing a rapid rate of combustion only when there is a heating demand.

It is another object of the present invention to heat air by channeling it around the firebox of a solid fuel furnace in a most efficient and economical manner.

It is yet another object of the present invention to construct a solid fuel furnace in which the heated air leaving the furnace is at a maximally high temperature.

Another object of the present invention is to prevent flash-back in a solid fuel furnace.

It has been found in the prior art devices that the temperature within the furnace can rise to a dangerous degree, when the room thermostat is calling for heat, and I have provided in the present invention apparatus for limiting the maximum temperature within the firebox.

Additionally, the present invention includes structure which permits manual operation of the furnace to allow continuous flow of air into the combustion chamber without any electrically operated blower in the event of power failure. And, finally, there is a safety provision to limit the air which flows into the combustion chamber at a time when there should be little or no combustion.

Hence, an object of the present invention is to provide "flash-back" prevention devices in a solid fuel furnace.

A further object of the present invention is to control the flow of air into the combustion of a solid-fuel furnace when the furnace door is opened.

An additional object of the present invention is to limit the maximum temperature within the combustion chamber of a solid-fuel furnace.

The present invention has another object in that it manually controls the operation of the folid-fuel furnace of the present invention in case of a power failure that would render the electrically-operated blowers inoperative.

Other objects, advantages and features of the present invention will become apparent from the following description when taken in conjunction with the accompanying drawings.

BRIEF DESCRIPTION OF THE DRAWINGS

FIG. 8 is a fragmentary perspective view of the rear of the solid fuel furnace of the present invention illustrating the location of the draft control apparatus.

FIG. 9 is a side elevational view, partly in section, showing the manual control for the draft control apparatus.

FIG. 10 is an end elevational view of the draft-control mechanism of FIG. 9.

DESCRIPTION OF THE PREFERRED EMBODIMENTS

Figure 1:
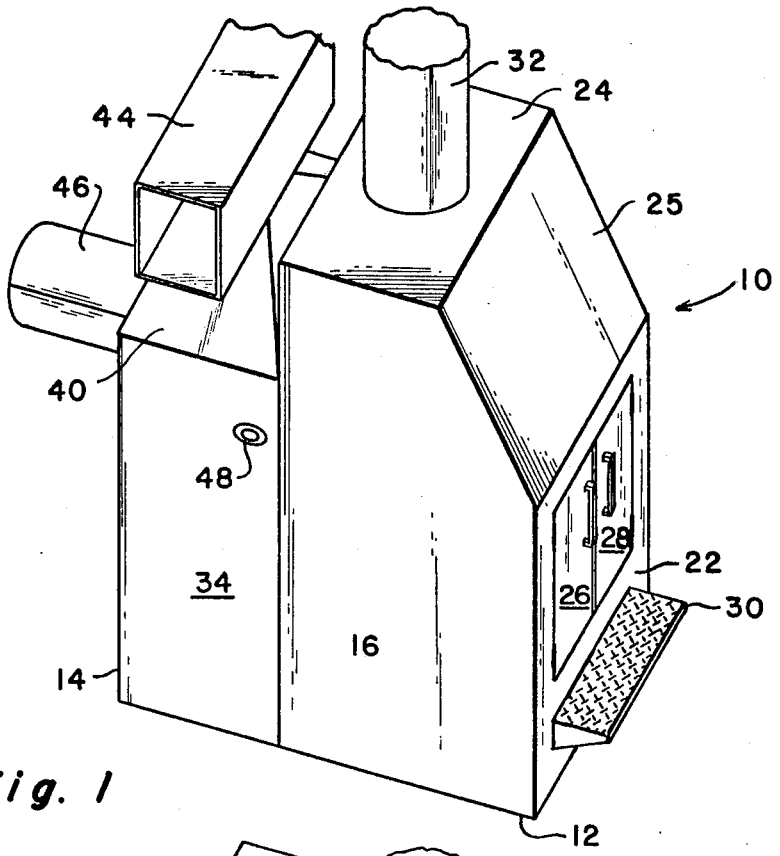
FIG. 1 is a perspective view of a solid fuel furnace constructed according to the present invention.

As is shown in FIG. 1, the present invention is embodied in a solid fuel furnace, indicated generally at 10, constructed according to the present invention. The furnace 10, which is preferably fabricated from welded sheet steel, includes, as viewed from the exterior in FIG. 1, a heating chamber 12 and an auxiliary chamber 14 attached behind it. The heating chamber 12 exterior is composed of a pair of heating jacket side walls 16 (only one shown) joined by a furnace base 20, a front wall 22, an outer top wall 24, and an outer canted wall 25 joining the outer top wall 24 to the front wall 22. A pair of hinged doors 26 and 28 are provided in the front wall 22 and a ledge piece 30 with a textured top surface is provided as a shelf just below the doors 26 and 28 on the front wall 22. A flue stack 32 is provided extending upward from the outer top wall 24.

The auxiliary chamber 14 includes a pair of auxiliary chamber side walls 34 (only one shown), which are connected by the furnace base 20, a rear wall 38, a pyramidal-shaped air intake chamber 40, and a firewall 42 which forms the front wall of the auxiliary chamber 14 as well as the rear wall of the heating chamber 12. An air intake duct 44 is provided connected to the air intake chamber 40 on the top of the auxiliary chamber 14. A heated air duct 46 extends rearwardly from the rear wall 38 of the furnace 10. A combustion air intake port 48 is provided in the auxiliary chamber side wall 34.

Figure 2:
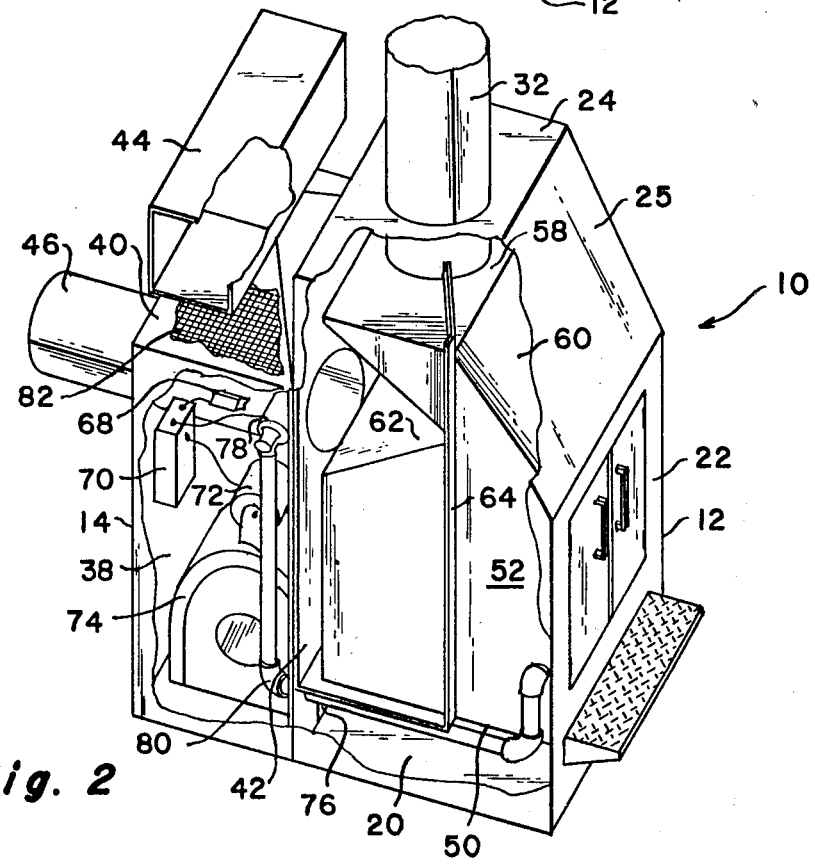
FIG. 2 is a perspective view similar to the furnace of FIG. 1 with a portion of the side wall cut away.

As can be seen from the cut-away view of the furnace 10 in FIG. 2 in which most of the heating jacket side wall 16 and auxiliary chamber side wall 34 have been removed, inside of the heating chamber 12 there is formed a firebox 50. The firebox 50 is formed by a pair of firebox side walls 52 (only one shown) connected by a firebox base 56, a firebox rear wall (not shown), the front wall 22, an inner top wall 58 and an inner canted wall 60 joining the inner top wall 58 to the front wall 22. A smoke shelf 62 is formed as a ledge or indentation in the firebox rear wall (not shown) and it extends forwardly forming a narrowed region of the firebox 50 between the smoke shelf 62 and the inner canted wall 60. The flue stack 32 extends intact through the outer top wall 24 to join the inner top wall 58 and open into the interior of the firebox 50. A pair of identical baffles 64 (only one shown) formed on each side of the firebox 50 extending between the firebox side walls 52 (only one shown) and the heating jacket side walls 16 and 18 with only one baffle 64 being seen in FIG. 2. The lower section of the baffle 64 extends horizontally forward from the firewall 42 along the bottom of the firebox 50. Approximately midway across the firebox side wall 52 the baffle 64 turns vertically upward extending to the top of the firebox side wall 52. A top section of the baffle 64 extends across the top of the inner top wall 58 to the flue stack 32. A portion of each of the baffles 64 extends inwardly between the firebox rear wall (not shown) and the firewall 42 so that the baffles 64 are joined behind the firebox 50. All along its lower sections the baffle 64 extends completely between the respective surface of the firebox 50 and the heating chamber 12 but the spacing between the inner and outer top walls 58 and 24 is such that an air gap is left between the top section of the baffle 64 and the outer top wall 24.

The details of the interior of the auxiliary chamber 14 can also be seen in FIG. 2. The heated air duct 46 extends intact through the auxiliary chamber 14 and opens through the firewall 42 into the interior of the heating chamber 12 adjacent the area of the smoke shelf 62 in the firebox 50. A normally closed, bimetal operated, high thermal limit switch 68 is secured to the heated air duct 46 and a normally opened, bimetal operated, thermally responsive fan switch 70 is mounted on the rear wall 38 of the furnace 10. A main motor 72 is connected by wiring to the fan switch 70 and is mechanically linked as by a drive belt to a circulating air fan 74 having its intake opening in the interior of the auxiliary chamber 14 and its output connected to the air port 76 located generally in the firewall 42 in the space between the firebox base 56 and the furnace base 20. Also located in the auxiliary chamber 14 mounted on the auxiliary chamber side wall 34 around the combustion air intake port 48 is a combustion air blower 78 which is also connected by wiring to the limit switch 68. Combustion air tubing 80 extends downwardly from the combustion air blower 78 and then forwardly through the firewall 42 to the forward part of the heating chamber 12 in which it extends upwardly again and then through the firebox side wall 52 into the firebox 50. Also in the auxiliary chamber 14 located at the base of the air intake chamber 40 is a filter 82.

Figure 3:
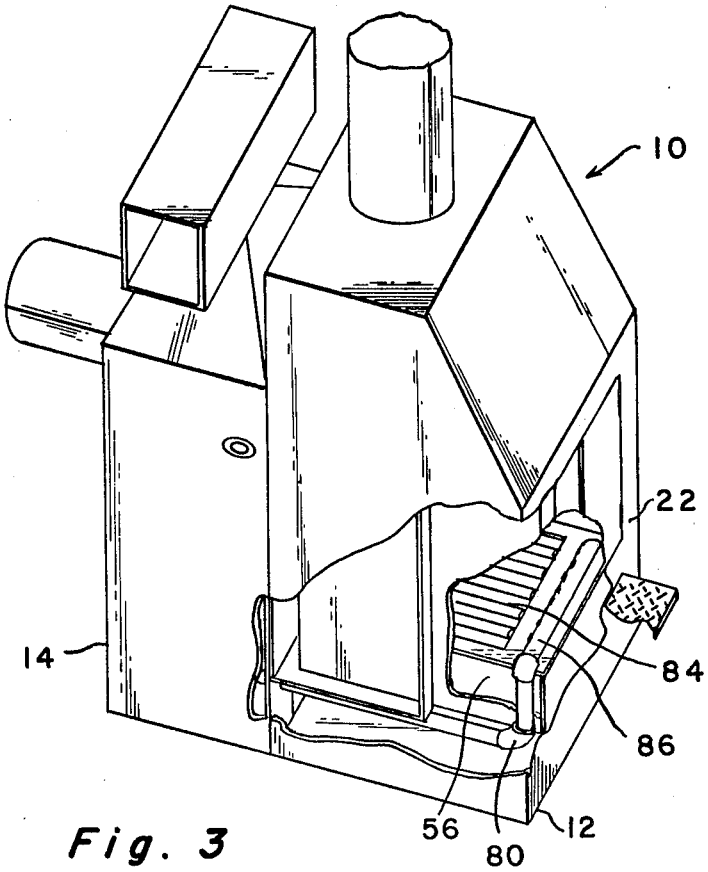
FIG. 3 is a perspective view similar to the furnace of FIG. 1 with a portion of the side wall and a portion of the firebox cut away.

The interior of the firebox 50 can best be seen in FIG. 3 in which a portion of the firebox side wall 52 and the front wall 22 have been removed. A raised grate 84 is provided inside the firebox 50 spaced above the firebox base 56 to support the fire thereon. A combustion air ejection manifold 86 is provided in the forward part of the firebox 50 and is connected to the combustion air tubing 80. A plurality of rearwardly facing holes are formed in the combustion air ejection manifold 86.

Figure 4:
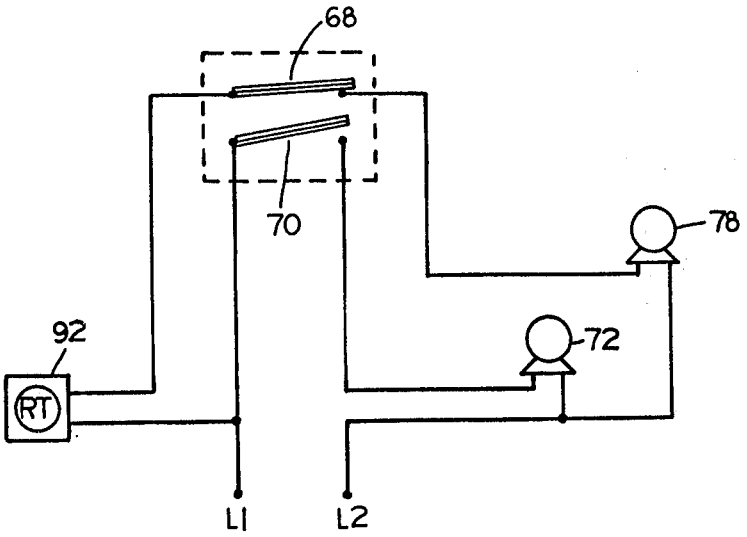
FIG. 4 is a schematic diagram of the control circuit for the furnace of FIG. 1.

The control circuitry for the furnace 10 of FIGS. 1–3 is shown in FIG. 4 with the fan and limit components contained in an assembly represented by a dashed line. The fan switch 70 and the limit switch 68 are electrically connected by suitable wiring to power lines $L_1$ and $L_2$. A room or space thermostat 92 of any conventional structure, such as a spiral bimetal with a temperature setting dial, is wired in series with the limit switch 68 and the combustion air blower 78. The fan switch 70 is wired in series with the circulating air fan 72. It is to be understood that other wiring arrangements may be utilized in accordance with particular installation requirements. For example, the line thermostat 92 may be replaced with a 24 volt thermostat by inserting a step down transformer across the power lines $L_1$ and $L_2$. It should also be understood that many other types of fan and limit switches may be utilized and may be located in a variety of places to conform to installation requirements.

In the operation of the furnace 10 of FIGS. 1–4, the fire is built of wood or coal on the grate 84 in the firebox 50. Access to the fire is through the doors 26 and 28. The hot combustion gases from the fire rise to strike the smoke shelf 62 and then snake between the smoke shelf 62 and the inner canted wall 60 before exiting through the flue stack 32. Thus the firebox 50 and the air surrounding it are heated, with the heat being the most intense in the area around the smoke shelf 62.

The combustion air blower 78 when energized draws air in through the combustion air intake port 48 and forces it under pressure into the combustion air tubing 80. The air passes through the combustion air tubing to the combustion air ejection manifold from which it exits through the rearwardly facing holes in the manifold 86. This combustion air system thus serves to inject air directly into the fire to increase the speed and heat of combustion so that the fire supplies more heat during times of heat demand. This feature thus economizes the use of the solid fuel by causing the fire to burn its hottest only when heat demand is required while allowing the fire to subside between times of heat demand to save fuel.

The motor 72 operates the blower 74 to supply the main heated air. The fan 74 draws air from the auxiliary chamber 14 causing a suction which draws air from the air intake duct 44 into the air intake chamber 40 and through the filter 82 into the auxiliary chamber 14. The output air from the fan 74 is forced under pressure into the interior of the heating chamber 12 underneath the firebox 50. This air is channeled by the baffles 64 underneath of the firebox 50, then upwardly along the sides of the firebox and then rearwardly again over the top section of the baffles 64 and 66 on the inner top wall 58. The heated air then is forced downward into the area adjacent the smoke shelf 62 for its final heating before exiting through the heated air duct 46 to be carried to the space to be heated.

The configuration of the firebox 50 and the baffles 64 enable the furnace 10 of FIGS. 1–3 to be particularly efficient in the heating of the intake air. The intake air is exposed to progressively hotter portions of the firebox 50 to ensure that all this air is evenly heated and that it is at its maximum temperature as it leaves the furnace 10. Thus the air port 76 is located underneath the firebox base 56 which, because heat rises, will be the coolest part of the firebox 50. Then the air is directed by the baffles 64 along the front portions of the firebox side walls 52 and 54 which are exposed to the radiant heat of the fire. Then the air is directed over the inner top wall 58 and around the flue stack 32 where the hot combustion gases rise before leaving through the flue stack 32. Finally, the exit for the heated air through the heated air duct 46 is adjacent the smoke shelf 64 which will be the hottest point in the firebox 50 since it is directly over the flames themselves. Thus the heated air leaves at the highest possible temperature, maximizing the efficiency of the furnace 10.

To commence operation of the furnace, the solid fuel, wood, coal, etc., on the furnace grate is ignited by any conventional means, such as a match. With the room thermostat 92 in an unactuated condition, the circuit for the combustion air blower 78 is deenergized; at the same time since there is not heated air in the heated air duct 46, the normally opened fan switch 70 remains open so that the circuit for the circulating air fan is deenergized.

Assuming now there is a demand for heat, the room thermostat 92 closes completing a circuit from power line $L_1$ through the room thermostat 92, the normally closed limit switch 68 and the combustion air blower 78 to the power line $L_2$. Energization of the fan 78 forces auxiliary combustion air through the manifold 86 whereupon the solid fuel on the grate 84 will burn at a high rate.

After a predetermined time period, the furnace becomes heated and the thermally responsive fan switch 70 is closed. Thus, a circuit is completed from the power line $L_1$ through the fan switch 70 and the circulating air fan motor 72 to the power line $L_2$. Energization of the motor 72 forces heated circulating air out of the heated air duct 46 to the room of space being heated.

When the room is sufficiently heated and the temperature rises to the set temperature of the room thermostat 92, the room thermostat opens causing the combustion air blower 78 to be deenergized whereupon the solid fuel on the grate 84 will only burn at its lower rate. However, the circulating air fan 74 remains energized for a time period as sensed by the thermally responsive fan switch 70. As soon as the heated air is dissipated through the circulation system, the fan switch 70 will sense cool air whereupon the fan switch will open causing deenergization of the circulating air fan 74.

If, for any reason, the temperature in the furnace should exceed a predetermined limit as sensed by the high thermal limit switch 68, this normally closed switch 68 will open causing deenergization of the combustion air blower 78.

Figure 5:
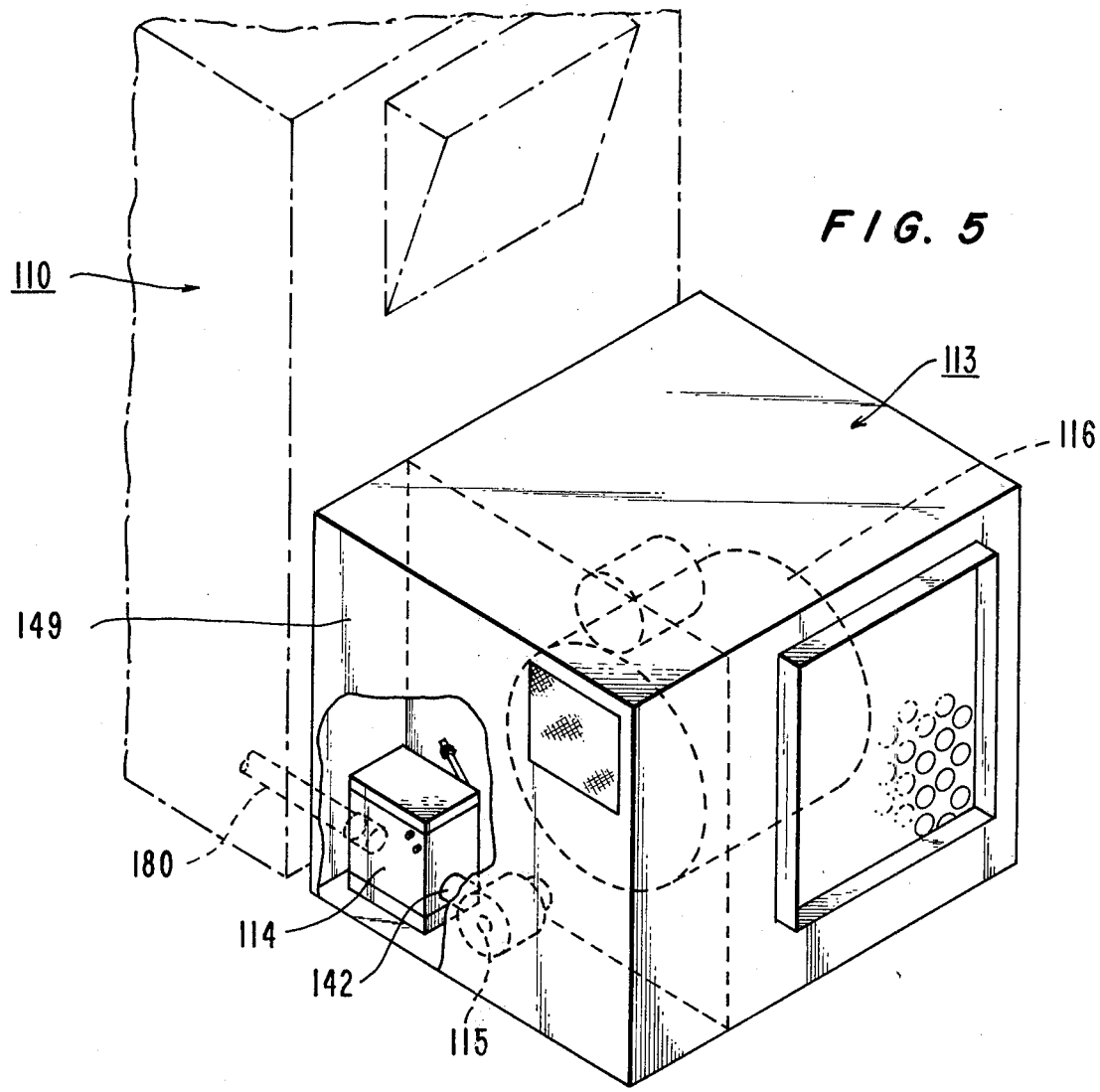
FIG. 5 is a fragmentary perspective view of the front of a modified solid fuel furnace of the present invention showing the door arrangement for loading fuel and for cleaning out the ash pit.

The modified solid fuel furnace of FIGS. 5–11 of the present invention is similar in general construction to that shown in FIGS. 1–4 so that the details of that construction will be minimized so as to simplify the description and to emphasize the different details. As is shown in FIG. 5, the furnace generally includes a combustion portion 110, having a firebox 111 with a fuel grate (not shown) for receiving the solid fuel to be burned in the furnace. This combustion portion includes the appropriate sheet metal body 112 providing a duct (not shown) through which the combustion gases rise to heat the sheet metal of the combustion portion, prior to being discharged through an appropriate chimney (not shown). This structure may be made in such a way as to include an initial hotter portion and a tortuous path for the combustion gases so that there will be hotter and also cooler portions of the combustion member, all as described above. The rear portion 113 includes the draft control apparatus 114, hereinafter more fully described, and the combustion air fan 115 and the air circulating fan 116, also referred to more fully in detail hereinafter.

Referring now particularly to FIGS. 8, 9 and 10 there is illustrated a fuel door 117 and the ash pit door 118, pivotally supported as at **117-*a* and 118-*a*, respectively, on the front wall of the combustion portion 119** of the furnace.

As is shown particularly in FIG. 10, the doors swing outwardly on the hinges **117-*a* and 118-*a* to provide access to the interior of the combustion area, to permit the introduction of fuel through the opening 119, and for the removal of the ashes through the opening 120**.

As has been previously stated, the temperature within the combustion chamber 119 has, in the past, risen to such levels as to overheat the furnace and also to create a danger upon the inrush of large quantities of air when the door 117 is opened, to create a "flash-back". To prevent such occurrences, the door 117 is especially constructed as set forth below.

The door 117 is constructed of a front plate 121 which overlies the opening 119 and on which the hinges **117-*a* are fastened. This plate is constructed of heavy metal and is reinforced with the rectangular, tubular channels 122, 123 and 124. This provides a solid and heavy construction which is not easily or accidentally opened but which can be swung on the hinges 117 by pulling up on the wooden handle 125**.

On the inner side of the door 117, between the channels 122 and 123, is a closure plate 126, and this plate creates, between the front plate 121, the channels 122 and 123 and itself, a box-like structure **121-*a*. At one end of the closure 126 are a series of holes 127 (generally vertically aligned as shown particularly in FIG. 10) and at the other end of the chamber 121-*a*, in the front plate 121, is another series of holes 128 (generally in a circular pattern) also as seen in FIGS. 9 and 10**.

It is clear that the holes 128 and 127 create a pair of openings in the chamber **121-*a* so that air may flow through the door 117** when the ports are unobstructed.

Additionally, there is a baffleplate 129 fastened in spaced relationship to the inner side of the rectangular tubes so that the flames within the firebox 110 will not enter the door chamber **121-*a* through the ports 127**.

As is shown particularly in FIGS. 8 and 9, a cover 130 for the ports 128 is a circular disc which is fastened to the toggle-arm 131 and a handle 132, and pivotally mounted at 133 on the front wall of the furnace. The toggle arm and handle 131 and 132 provide the dual function of bringing the cover 130 into closing relation over the ports 128 and also for securely locking the door 117 in closed position when the handle is thrown to that position shown in FIG. 8.

When the handle 132 is moved to a position shown in FIG. 19 the cover 130 is moved away from the ports 128 allowing air to flow through those ports and the door chamber 121-*a* and the ports 127 into the combustion chamber 111. Under such circumstances, the door 117 remains closed and kept in closed position by the interlock plate 134 hereinafter to be described.

However, as can be seen, when the cover 130 is moved away from the ports 128, air can enter the combustion chamber 111 through the arrangement just described so as to prevent flashback which would otherwise occur in an overheated combustion chamber 111 if the door 117 were fully swung open.

Referring now to the ash pit door 118, this door also includes a toggle lock arrangement 135 having an adjustable bolt 136 and a handle 137 which keeps the door in closed position when the handle 137 is in the location shown in FIG. 8.

When the handle 137 is moved to that location shown in FIG. 10 the ash pit door 118 can swing open as shown in FIG. 10 carrying with it the interlock tab 134 which is securely and permanently fastened to the front plate 138 of the ash pit door 118. This interlock plate overlies the bottom edge of the combustion chamber door 117, as shown particularly in FIGS. 8 and 9 thus preventing the opening of the combustion door 117, even though the handle 132 therefor is thrown into the position shown in FIG. 9 until such time as the ash pit door handle 137 is thrown into position shown in FIG. 10. At that time the ash pit door may be swung open on its hinges 118-*a* by drawing on the handle 139, permitting the combustion chamber door 117 also to be swung open at its hinges.

With the above arrangement, the ash pit door 118 may be opened individually without opening the combustion chamber door 117 for removal of ashes, cleaning etc.

It will also be seen, by reference to FIG. 10 that the front plate 138 of the ash pit door 118 is reinforced with large tubular iron channels 140 and 141, providing not only rigidity and security, but also the heavy weight desirable in this construction.

Figure 6:
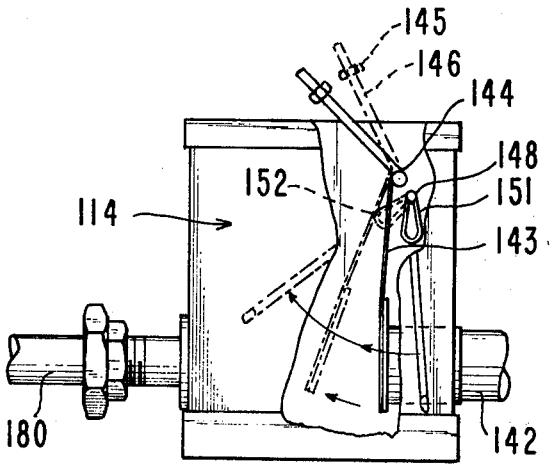
FIG. 6 is a fragmentary perspective view, similar to FIG. 5, illustrating the "blow-back" prevention port in open position.
Figure 7:
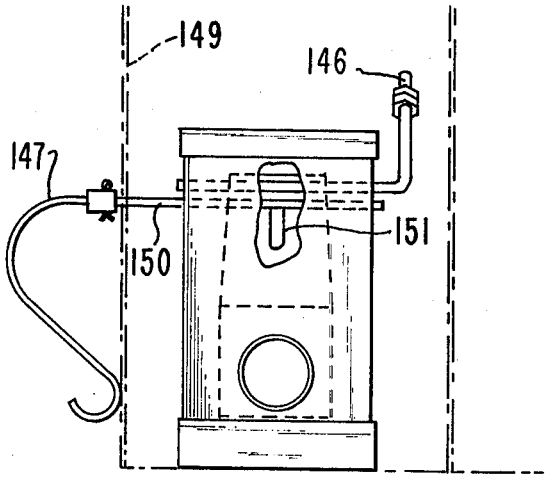
FIG. 7 is a fragmentary perspective view, similar to FIG. 5, showing the fuel loading door and the ash pit door in an open position.

With reference now to the draft control apparatus, attention is directed to FIGS. 5, 6 and 7 as well as to FIGS. 1, 2 and 3 wherein a separate conduit is provided for feeding combustion air into the combustion chamber adjacent to the grate which holds the fuel. Such an arrangement is shown by the conduit 180 in FIGS. 5 and 6. The blower assembly and draft control apparatus includes the combustion air fan 115 and the conduit 142 which forces the air into the draft control apparatus 115 and thence out to the conduit 180, as is illustrated in FIG. 6.

Within the draft control apparatus 115 is a flapper valve 143 which is pivoted at 144 so as to hang vertically and to close the conduit 142 when the flapper valve 143 is in a vertical position.

An adjustable counterweight 145, supported on an arm 146, is also connected to the flapper 143 to insure that the flapper 143 remains in closed position when no combustion air is desired to flow through the conduit 180. Under normal operation, the counterweight 145 is so positioned on the arm 146 that when air is forced through the pipe 142 by the action of the blower 115, the flapper valve 143 will rise to the dotted position shown in FIG. 6 to permit air to pass through the conduit 180 into the combustion chamber.

The operation of the blower 115 for forcing such combustion air through the conduit 180 is controlled by the electrical circuit hereinafter described.

However, under certain circumstances, as when the failure of an electrical supply exists, it will be desirable to have the flapper valve 143 open to permit combustion air to enter through the conduit 180, even through the blower 115 is inoperative. Therefore, a handle 147 is pivoted in the housing of the draft control apparatus, as at 148, and extending through the side wall 149 of the furnace, as is shown in FIG. 7. The horizontal portion 150 of the handle 147 includes a cam 151 disposed in alignment with a flapper 143, so that the cam 151 may be brought against the flapper 143 to lift the flapper into an open position as shown in the dotted lines at FIG. 6, when the handle moves the cam to the position 52 as shown in FIG. 7. This manual control then serves as an override against the counterweight action of the counter-balance 145 and keeps the flapper in open position to permit combustion air to flow into the conduit 180 as long as the manual override control is held in the position shown in the dotted line in FIG. 6.

Figure 11:
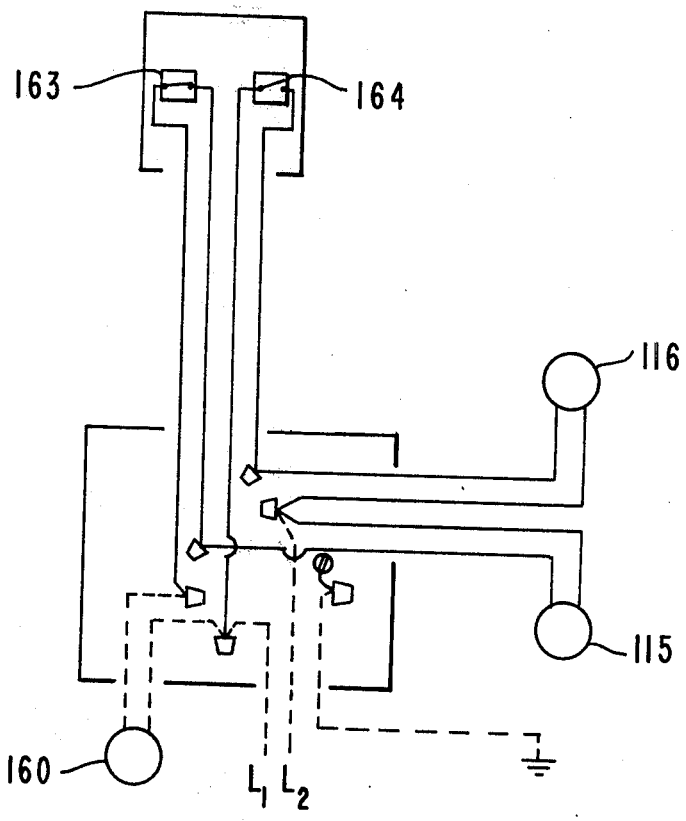
FIG. 11 is a schematic diagram of the control circuit for the furnace of FIG. 5.

Referring now to the schematic diagram in FIG. 11, a safety control mechanism of the present invention is shown, which prevents the overheating of the combustion chamber and prevents the temperature in the combustion chamber rising up above safe levels.

A room thermostat 160 is electrically disposed in a circuit which includes the power line L-1 and L-2, a combustion fan 115 and an air circulating fan 116, and also a high-limit, thermostatic switch 163 disposed adjacent the combustion area and an on-off thermostatic control switch 164 for the air-circulating fan 116.

The high-limit switch 163 for the combustion chamber is normally set at a lower limit of 100° F. and an upper limit of 140° F. so that the combustion fan 15 will force combustion air into the combustion chamber only when the control drops below 100° F. and will stop when it rises to 140° F. When the combustion chamber temperature rises to 140° F. the combustion fan 15 will turn off and the temperature will drop within the combustion chamber.

The control switch 164 for the air circulating fan 116 is normally set for a low temperature of 90° F. and a high temperature of 110° F. so that if the temperature of the air in the discharge conduit of the furnace (shown at 46 in FIG. 1) drops below 90° F., the switch will actuate the air circulating fan 116 and cause it to operate until the temperature of such air rises to a maximum of 110° F., at which time the air circulating fan 116 will shut off.

It will be seen from the circuit diagram that the air circulating fan and the circulating air limit switch operate independently of the thermostat, and that the thermostat does not control this large blower for circulating the heated air. The thermostat is connected in the circuit with the limit switch for the combustion air fan, and the limit switch for the circulating air fan is the only control for the main blower.

Without the controls of the present invention, there is danger of the fire "running away" and the temperature in the combustion box can reach as high as 750° F. With the devices of the present invention, the combustion box temperature can never rise above 221° F., and usually not above 140° F. The air is discharged into the room at about 90° and 110° F.

Since many modifications, variations, and changes in detail are possible within the scope of the present invention, it is intended that all material contained in the foregoing description or shown in the accompanying drawings shall be interpreted as illustrative and not in a limiting sense.

What is claimed is:

1. A solid fuel furnace comprising a firebox for containing a fire therein, a combustion air manifold for supplying air to the firebox, a heating chamber surrounding the firebox, a circulating fan to force air through the heating chamber and around the firebox to circulate heated air to a room, a normally open limit switch responsive to temperature within the heating chamber for controlling said circulating fan, a thermostat responsive to temperature of the room, a normally closed high thermal limit switch responsive to the temperature in the heating chamber, a combustion air blower controlled by the thermostat and the high limit switch in series, said blower being connected to the combustion air manifold whereby air is injected into the firebox to increase the rate of combustion of fuel therein when there is a heating demand, an auxiliary chamber joined to the heating chamber by a firewall, the circulating air fan and the combustion air blower being located in the auxiliary chamber, wherein the firebox has a firebox base and the furnace has a furnace base with the firebox base being spaced above the furnace base, and wherein the circulating air fan output enters the heating chamber underneath the firebox base, a smoke shelf formed as an indentation in the firebox, a heated air duct extending through the auxiliary chamber and opening through the firewall into the heating chamber adjacent the smoke shelf in the firebox, and a pair of baffles, one on each side of the firebox, each baffle being connected to both the respective side wall of the firebox and the outer side wall of the heating chamber, the baffles directing air from the circulating air fan from underneath the firebox upwardly along the sides of the firebox to the top of the firebox and then downwardly along the rear wall of the firebox to enter the heated air duct.

2. A solid fuel furnace as recited in claim 1, further comprising an air conduit extending between the combustion air blower and the combustion air manifold, a flapper valve for controlling air flow through the conduit, a counterweight to shut the valve when the combustion air blower is inoperative, said valve opening against the action of the counterweight when the combustion air blower is operative, a cam rotatably supported adjacent the flapper valve whereby the valve may be opened by rotation of the cam, and a handle outside the furnace for rotating the cam whereby the valve may be manually opened when the combustion air fan is inoperative.

* * * * *